US008177866B2

(12) United States Patent
Balfanz et al.

(10) Patent No.: US 8,177,866 B2
(45) Date of Patent: May 15, 2012

(54) FUEL FOR DIESEL ENGINES

(75) Inventors: Ulrich Balfanz, Haltern am See (DE); Jörg-Christian Fröhling, Witten (DE); Angela Spieckermann, Bochum (DE); Rudolf Terschek, Bochum (DE)

(73) Assignee: BP Europe SE, Hamburg (DE)

( * ) Notice: Subject to any disclaimer, the term of this patent is extended or adjusted under 35 U.S.C. 154(b) by 702 days.

(21) Appl. No.: 11/376,078

(22) Filed: Mar. 15, 2006

(65) Prior Publication Data

US 2006/0207167 A1 Sep. 21, 2006

(30) Foreign Application Priority Data

Mar. 17, 2005 (DE) ..... 10 2005 012 807

(51) Int. Cl.
*C10L 1/183* (2006.01)
*C10L 1/08* (2006.01)

(52) U.S. Cl. ..... 44/450

(58) Field of Classification Search ..... 585/12; 568/609; 208/108, 15; 524/117; 44/450, 44/393

See application file for complete search history.

(56) References Cited

U.S. PATENT DOCUMENTS

| | | | | | |
|---|---|---|---|---|---|
| 2,891,851 | A * | 6/1959 | Bailey et al. | 44/322 |
| 3,062,896 | A * | 11/1962 | Davis | 568/718 |
| 3,598,552 | A * | 8/1971 | Cohen et al. | 585/12 |
| 3,699,173 | A * | 10/1972 | Osberg et al. | 568/609 |
| 4,326,972 | A * | 4/1982 | Chamberlin, III | 508/331 |
| 4,780,230 | A * | 10/1988 | Liu et al. | 508/259 |
| 4,877,834 | A * | 10/1989 | Liu et al. | 525/66 |
| 5,017,633 | A * | 5/1991 | Tscheulin | 524/117 |
| 5,076,814 | A * | 12/1991 | Hanlon et al. | 44/450 |
| 5,326,485 | A * | 7/1994 | Cervenka et al. | 508/373 |
| 6,136,049 | A * | 10/2000 | Nakajima et al. | 44/393 |
| 6,299,655 | B1 * | 10/2001 | Steckel et al. | 44/331 |
| 6,475,252 | B1 * | 11/2002 | Heneghan et al. | 44/435 |
| 6,596,672 | B1 * | 7/2003 | Carrick et al. | 508/192 |
| 6,884,271 | B2 * | 4/2005 | Wenzel | 44/302 |
| 6,946,008 | B2 * | 9/2005 | Wenzel | 44/302 |
| 2003/0134756 | A1 * | 7/2003 | Carrick et al. | 508/398 |
| 2006/0138024 | A1 * | 6/2006 | Miller et al. | 208/108 |

* cited by examiner

*Primary Examiner* — Ellen McAvoy
*Assistant Examiner* — Chantel Graham
(74) *Attorney, Agent, or Firm* — Kelly L. Cummings

(57) ABSTRACT

The invention concerns a fuel to operate Diesel engines, in particular in cars, wherein the fuel contains an antioxidant. To achieve that the discoloration of the water white Diesel fuel during longer storage and/or incident light radiation is prevented at least for longer periods, the fuel contains a para-substituted, sterically hindered phenol (I) as antioxidant, the substituent of which in the para position is different from a tertiary butyl group.

9 Claims, No Drawings

FUEL FOR DIESEL ENGINES

BACKGROUND OF THE INVENTION

The invention concerns a fuel to operate Diesel engines, in particular in cars, wherein the fuel contains an antioxidant.

Diesel fuels for cars are obtainable at many service stations. Modern Diesel fuels contain a number of additives, inter alia also antioxidant agents, which ensure, for example, the storing and ageing stability of the fuel.

In recent years, new Diesel fuel formulations are available in many markets which fuels are intended to reduce certain undesirable emissions and other undesirable characteristics. For example, since June 2004 new Diesel fuels are available on the German market, that are offered in addition to the conventional Diesel fuels. These new fuels are characterized by great improvement of the output, reductions of the noxious materials in the exhaust gas and decrease of consumption. Apart from the markedly reduced intensity of odor, a further feature of these fuels is its water white appearance. This crystal clear appearance should express, inter alia, the particular operational efficiency of the fuel. The color picture of the new Diesel fuel with approx. 50 Hazen markedly differs from the color reference numbers of conventional Diesel fuels, that have values of 200-300 Hazen.

A problem has occurred due to the fact, that the water white color of the new fuel during storage or when the fuel was exposed to daylight or sunshine, could not be maintained. Depending on the intensity of the incident light a discoloration of the fuel towards the yellowish occurred to a greater or lesser degree.

SUMMARY OF THE INVENTION

In an embodiment, this invention provides an additive, that is capable to hinder or prevent, at least over a long period, the discoloration of the water white Diesel fuel during a long storage and/or incident light radiation. In this case under light exclusion the optical impression of a water white fuel should be present even after a storage of 3 months or longer. Should the fuel be exposed to daylight, a corresponding color stability should exist at least for 2 days, ideally up to one week. This invention provides a fuel to operate Diesel engines, in particular in cars, comprising an antioxidant having a para-substituted, sterically hindered phenol (I), the substituent of which in the para position is not a tertiary butyl group.

In some embodiments, the phenol (I) is substituted in both ortho positions by a tertiary alkyl group each. Preferably the tertiary alkyl group is a tertiary butyl group.

In some embodiments, the fuel contains at least one additional para-substituted, sterically hindered phenol (II) wherein the para position of the phenol (II) is substituted with a tertiary alkyl group. Preferably, the ratio of phenol (I) to phenol (II) is from about 1:1 to about 20:1, more preferably from about 5:1 to about 15:1 most preferably about 10:1.

Optionally, both ortho positions of the phenol (II) are substituted by a tertiary alkyl group each, preferably the same tertiary alkyl group each, more preferably a tertiary butyl group.

In some embodiments, this invention provides a fuel which remains at or below 100 Hazen for at least 3 days, preferably at least 6 days, if the fuel is exposed to light or 3 months if the fuel is not exposed to light.

In any embodiment, Phenol (I) can be substituted in the para position with an n-alkyl group with a C number of 1 to 4. Preferably, the n-alkyl group is a methyl group. The phenol (I) is preferably present in a concentration of 10 to 200 mg/kg, more preferably 50 to 100 mg/kg. The fuel of claim 1 wherein the n-paraffin content does not exceed 10% by volume.

In some embodiments, the fuel has the following properties:

Cetane number: >55
Sulfur content: <10 mg/kg
Density: 0.825 kg/L to 0.840 kg/L
Contents of aromatic compounds: max. 15% by weight
Contents of polyaromatic compounds: max 2% by weight

DETAILED DESCRIPTION

It has been shown, that the color change due to storage and/or incidence of light can be prevented or at least markedly reduced over a longer period when the fuel contains a para-substituted, sterically hindered phenol as antioxidant, whereby the substituent in the para position is different from a tertiary butyl group.

Particularly preferred are such sterically hindered phenols, in which the ortho positions are occupied by very bulky substituents. Particularly suitable are here tertiary alkyl groups. Preferred is the simplest of all tertiary alkyl groups, namely the tertiary butyl group.

In contrast to this the substituent in the para position is not a tertiary butyl group. In this position there is preferably a linear-chained alkyl group. These n-alkyl groups have preferably a C number of 1-4. Preferred are phenols with a methyl group in the para position.

A good color-stabilizing effect is achieved when the above described phenol is contained with a concentration of 10-200 mg/kg of fuel. A preferred range is 50-100 mg/kg of fuel. A fuel, containing this additive, has a greater color stability than the one with additives with conventional antioxidants. Preferably, the color reference number of 100 Hazen is exceeded only insignificantly even after 6 days of exposure to daylight. However, a slight change in color can be noticed in particular after the radiation by sunlight. It was, however, found that even this discoloration can be suppressed when in addition to the above described antioxidant at least one further active co-substance is added to the fuel.

This active co-substance is also a para-substituted, sterically hindered phenol, wherein, however, the para position is occupied by a tertiary alkyl group. Phenols preferred as active co-substance are those, wherein both ortho positions are substituted by a tertiary alkyl group each. Particularly suitable are sterically hindered phenols, wherein all substituents are identical in the ortho and para positions. Preferred are here, once again, tertiary alkyl groups with the simplest structure, therefore a tertiary butyl group.

With regard to the color stability of a water white Diesel fuel good results are achieved when the ratio of the sterically hindered phenol (I) to the active co-substance is in a range of 1:1 to 20:1. The preferred range is 5:1 to 15:1. Particularly good results are achieved when the ratio is approx. 10:1.

A fuel described above is characterized in that its color reference number does not exceed 100 Hazen, preferably 50 Hazen, for a period up to approximately 3 months if the fuel is not exposed to light or for 3 days, preferably a week, if the fuel is exposed to light.

A further subject matter of the invention is the application of a para-substituted, sterically hindered phenol as antioxidant in fuels, in particular in Diesel fuels, preferably in those based on mineral oils.

The Diesel fuel itself is a mixture of various refinery products. The water white appearance is obtained first of all basically by the combination of suitable refinery components that are also water white. A further advantage of the described fuel is that its n-paraffin content does not exceed 10% by volume.

Moreover, from this a particularly suitable fuel can be specified, as stated below:

Cetane number: >55

Sulfur content: <10 mg/kg

Density: 0.825 kg/L to 0.84 kg/L

Contents of aromatic compounds: 15% by weight or less

Contents of polyaromatic compounds: 2% by weight or less

The above represent specification of a summer quality fuel. In winter, cold stability, more precisely response behavior to cold, of BMCI 0-30, preferably 10-20, can be achieved by adding a wax with a poor aromatic compound content up to max. 5% by volume to the above described summer fuel. The summer quality has a density in the region of 0.83 kg/L, whereas the winter quality is in the region of 0.84 kg/L.

Example

In the attached table of examples the results of measurements of a fuel with different antioxidants, that was exposed to daylight, are listed. The measured values state the color reference number according to Hazen. The determination of the color reference number according to Hazen is a common method, that is often used for liquids, solvents and the like (see Rompps Chemielexikon, publisher: Thieme). The color reference number of the individual specimens were determined over a period of max. 6 days. If a color reference number of approx. 150 was achieved, the experiment was terminated. The various initial values at the respective commencement of the experiment can be attributed to that the different antioxidants used are involved in determining the color.

An increase of the concentration of an antioxidant, involved in the determination of the color, can, in some individual cases, even impair the result. In the case of antioxidants, which in the sense of the invention are not suitable, a marked discoloration takes place typically within a short time, in some cases after a few hours. Sterically hindered phenols exhibit a stabilizing effect, however, are expressed differently.

The numbers in the first line of the table state the service life in days. In the case of identical fuels the following antioxidants or combinations of antioxidants have been tested. The following sequence is the same as in the table of the measured values.

TABLE I

| Composition and Concentration of Additive |
|---|
| 1. >97% 2,4-dimethyl-6-tert.-butylphenol; 50 mg/kg |
| 2. 2,6-di-tert. butyl-4-nonylphenol; 50 mg/kg |
| 3. >70% 2,6 di-tert. butylphenol, <20% 2,4,6-tri-tert. butylphenol, <10% 2-tert. butylphenol; 50 mg/kg |
| 4. 2,6-di-tert. butyl-4-methylphenol; 100 mg/kg |
| 5. 2,6-di-tert. butyl-4-methylphenol and 2,4,6-tri-tert. butylphenol in a ratio of 10:1; 75 mg/kg |

TABLE II

| Hazen Values of Fuels | | | | | | | | | |
|---|---|---|---|---|---|---|---|---|---|
| | | time (days) | | | | | | | |
| | | 0 | 0.5 | 1 | 1.5 | 2 | 3 | 5 | 6 |
| 1 | Hazen | 28 | 120 | — | — | 207 | — | — | — |
| 2 | Hazen | 35 | 88 | — | — | 145 | — | — | — |
| 3 | Hazen | 18 | 142 | — | 236 | — | — | — | — |
| 4 | Hazen | 14 | — | 35 | — | — | 89 | — | 106 |
| 5 | Hazen | 8 | — | 37 | — | 45 | 54 | — | 48 |

That which is claimed is:

1. A Diesel fuel formulation having a stabilized water white color, comprising:

a. a Diesel fuel consisting of a mixture of water white refinery products; and b. a sterically hindered phenolic antioxidant consisting of (i) a para-substituted, sterically hindered phenol (I), wherein the substituent in the para position is not a tertiary butyl group and wherein the phenol (I) is substituted in the para position with an n-alkyl group with a C number 1 to 4 and in both ortho positions with a tertiary alkyl group, and (ii) a para-substituted sterically hindered phenol (II) selected from the group consisting of para-substituted sterically hindered phenols wherein the para position and both ortho positions of the phenol (II) are substituted with a tertiary alkyl group, wherein the ratio of phenol (I) to phenol (II) is from about 5:1 to about 15:1, wherein phenol (I) is present in a concentration of 10 to 200 mg/kg, and wherein the antioxidant hinders or prevents discoloration of the fuel, and wherein the diesel fuel formulation has a cetane number greater than 55 and up to only 15 weight percent of aromatic compounds.

2. The fuel of claim 1 wherein the tertiary alkyl group of the phenol (I) is a tertiary butyl group.

3. The fuel of claim 1 wherein the n-alkyl group of the phenol (I) is a methyl group.

4. The fuel of claim 1 wherein the phenol (I) is present in a concentration of 50 to 100 mg/kg.

5. The fuel of claim 1 wherein both ortho positions and the para position of the phenol (II) are substituted by the same tertiary alkyl group each.

6. The fuel of claim 1 wherein the tertiary alkyl group of the phenol (II) is a tertiary butyl group.

7. The fuel of claim 1 wherein the fuel remains at 100 Hazen or less for at least 3 days if the fuel is exposed to light or 3 months if the fuel is not exposed to light.

8. The fuel of claim 1 wherein a n-paraffin contents does not exceed 10% by volume.

9. The fuel of claim 1 wherein the fuel formulation has the following properties:

Sulfur content: <10 mg/kg

Density: 0.825 kg/L to 0.840 kg/L

Contents of polyaromatic compounds: max. 2% by weight.

* * * * *